US006227153B1

(12) United States Patent
Till

(10) Patent No.: US 6,227,153 B1
(45) Date of Patent: May 8, 2001

(54) ENGINE COOLING APPARATUS AND METHOD

(75) Inventor: Ronald H. Till, Fairview, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/398,408

(22) Filed: Sep. 17, 1999

(51) Int. Cl.[7] ..... F01P 7/02
(52) U.S. Cl. ..... 123/41.12; 123/41.15
(58) Field of Search ..... 123/41.15, 198 D, 123/41.12, 41.44, 41.1

(56) References Cited

U.S. PATENT DOCUMENTS

| | | |
|---|---|---|
| 3,621,907 | 11/1971 | Ephraim, Jr. et al. . |
| 3,648,715 | 3/1972 | Booth . |
| 3,863,612 | 2/1975 | Wiener . |
| 4,133,185 | 1/1979 | Dickey . |
| 4,231,384 | 11/1980 | Christensen . |
| 4,413,595 | 11/1983 | Potts, Jr. . |
| 4,656,973 | 4/1987 | Endres . |
| 4,711,204 | 12/1987 | Rusconi . |
| 4,894,780 | 1/1990 | Simonyi et al. . |
| 4,907,645 | 3/1990 | Dumas et al. . |
| 4,955,431 | 9/1990 | Saur et al. . |
| 5,036,803 | 8/1991 | Nolting et al. . |
| 5,392,741 | 2/1995 | Uzkan . |
| 5,566,745 | 10/1996 | Hill et al. . |
| 5,598,705 | 2/1997 | Uzkan . |
| 5,669,311 | 9/1997 | Hill et al. . |
| 5,828,967 | 10/1998 | Ueda . |

FOREIGN PATENT DOCUMENTS

| | | |
|---|---|---|
| 88909289 | 3/1993 | (EP) . |
| 92101161 | 8/1994 | (EP) . |
| 95119738 | 7/1996 | (EP) . |
| 98101530 | 8/1998 | (EP) . |
| 97907331 | 11/1998 | (EP) . |
| 08186926 | 12/1994 | (JP) . |
| 09195777 | 7/1997 | (JP) . |

*Primary Examiner*—Noah P. Kamen
(74) *Attorney, Agent, or Firm*—Carl A. Rowold, Esq.; Holland & Knight LLP; David G. Maire, Esq.

(57) ABSTRACT

An engine cooling apparatus for cooling the engine prior to a scheduled maintenance activity. A cool down controller receives a maintenance cool down signal and operates to place the cooling fan, coolant pump, coolant bypass valve and air control shutter in their respective maximum or increased cooling modes. These components are maintained in their maximum or increased cooling mode until the engine reaches a predetermined temperature which may be a function of an ambient temperature control signal. Interlocks may be provided to incorporate a motion control signal and/or a brake control signal.

20 Claims, 2 Drawing Sheets

ENGINE COOLING APPARATUS AND METHOD

BACKGROUND OF THE INVENTION

The present invention relates generally to the field of engine cooling, and more particularly, to an apparatus and method for cooling an engine prior to performing maintenance services on the engine.

Vehicle engines are known to generate a significant amount of heat during operation. Excess heat is dissipated to the environment during operation by means of a cooling system. During normal operations, the temperature of an engine may be maintained at a predetermined elevated temperature in order to promote the proper operation of the engine. For example, a diesel locomotive engine may be maintained at a normal operating temperature that is close to the boiling temperature of water. The portions of such an engine that are in contact with combustion gasses may actually operate at temperatures significantly above the boiling temperature of water. It may be appreciated that the total amount of heat energy stored in such a large engine is extremely large. When preparing such an engine for routine maintenance services, it is necessary to reduce the temperature of the engine to near ambient levels in order to protect the maintenance personnel from injury. A period of 8–12 hours may be necessary for a large diesel locomotive engine to cool to ambient conditions due to its large mass and the relatively high operating temperatures that exist when the engine is shut down. Because turnaround time is an important criteria for a repair facility for locomotives or other vehicles employing such large engines, such an extended delay is undesirable and costly.

U.S. Pat. No. 4,656,973 issued on Apr. 14, 1987, to Mark C. Endres, teaches a method and apparatus for cooling an engine that has been operated at a temperature on the high side of the allowable operating temperature range. The Endres patent recognizes that the engine bearings may become overheated when the engine is shut down at a higher than normal operating temperature. Endres teaches a method and apparatus for ensuring that the engine is kept running until the engine cooling system has reduced the temperature to a predetermined acceptable range. However, Endres does not address the problem of the extended cooling period necessary for an engine to cool to ambient conditions after being shut down from normal or overheated operating temperatures.

BRIEF SUMMARY OF THE INVENTION

Thus, there is a particular need for an engine cooling apparatus and method that will reduce the amount of time necessary to cool an engine from its normal operating temperature to a temperature wherein maintenance operations may be safely accomplished. Accordingly, an engine cooling apparatus is provided comprising: a radiator in fluid communication with the engine; a pump operable to pump fluid between the engine and the radiator to transfer heat from the engine to the radiator; a fan operable to move air past the radiator to transfer heat from the radiator to the air, the fan having an increased cooling mode; a coolant sensor operable to measure the temperature of the fluid and to produce a corresponding temperature signal; a controller operatively connected to the fan, the coolant sensor and the engine and having an input for receiving a maintenance cool down signal; logic within the controller operable to produce a signal for placing the fan in its increased cooling mode upon receipt of the maintenance cool down signal; and logic within the controller operable to deactivate the engine when the temperature of the fluid reaches a predetermined value after receipt of the maintenance cool down signal. Furthermore, a method of preparing an engine for maintenance is provided comprising the steps of: placing the engine cooling system in an increased cooling mode; maintaining the engine cooling system in an increased cooling mode until the temperature of the engine drops below a predetermined value; deactivating the engine and engine cooling system once the temperature of the engine drops below the predetermined value.

DETAILED DESCRIPTION OF THE INVENTION

Figure 1:
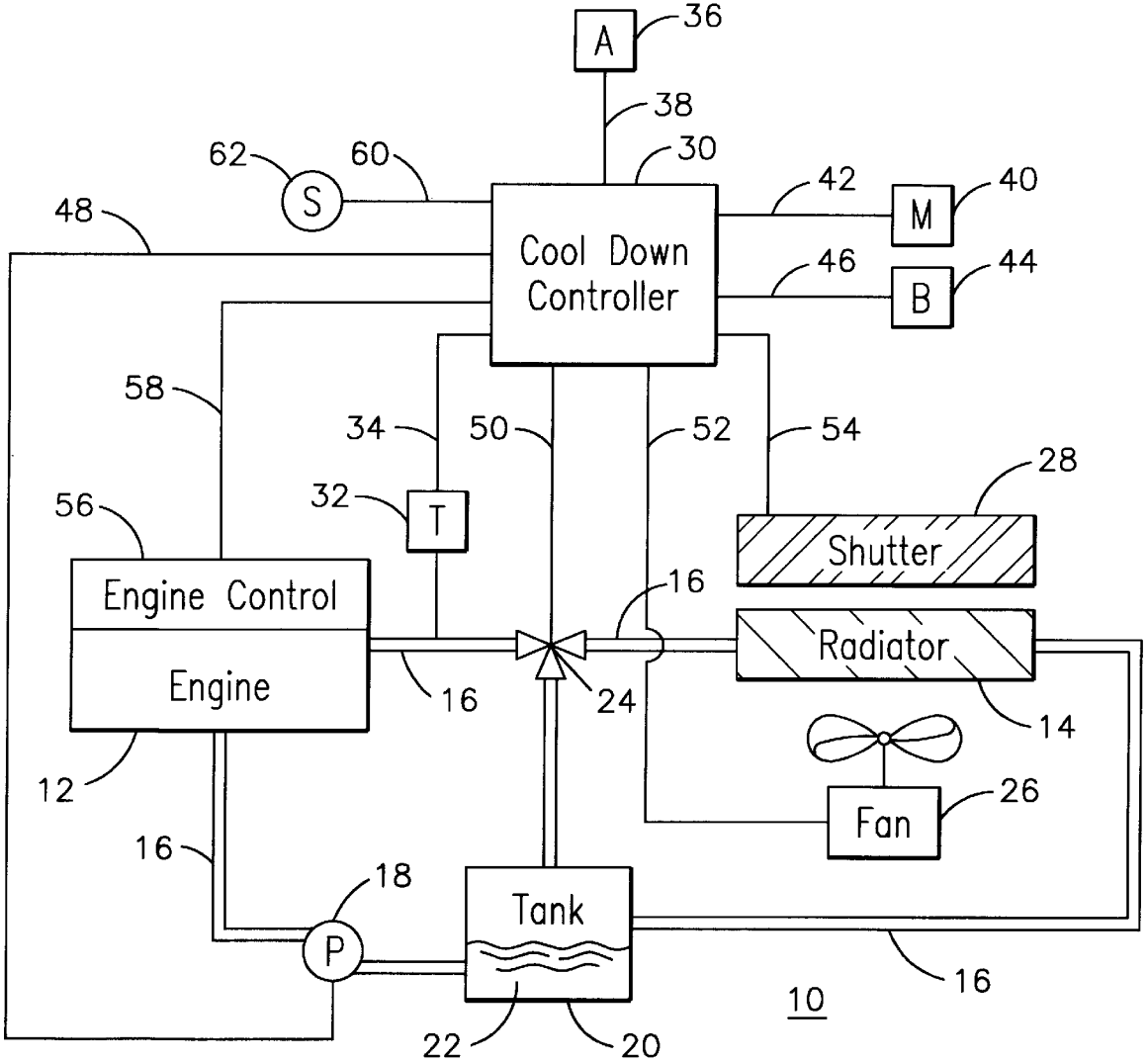
FIG. 1 is a schematic illustration of an engine cooling apparatus.

FIG. 1 illustrates an engine cooling apparatus 10 for an engine 12 that may be utilized to cool the engine 12 to a safe temperature prior to the performance of maintenance activities. Engine 12 may be any large power plant wherein the time required for passive cooling of the engine from its normal operating temperature to near ambient conditions is of a duration that impacts the efficient operation of a repair facility. In one embodiment, engine 12 may be a diesel locomotive engine. Other embodiments of engine 12 may include a truck motor, the motor of a large earth-moving vehicle, an airplane engine, or a non-vehicle engine such as, for example, an electrical generating power plant engine.

Engine cooling apparatus 10 includes a radiator 14 in fluid communication with engine 12. Radiator 14 and engine 12 are interconnected by coolant lines 16 to form a closed loop cooling circuit. The cooling circuit may include a pump 18 operable to pump a coolant 22 such as water or other cooling fluid, between the engine 12 and the radiator 14 to transfer heat from the engine 12 to the radiator 14. Pump 18 may have one or more speeds of operation, including a minimum speed and one or more increased speeds that represent an increased cooling mode. The cooling circuit may also include a tank 20 operable to control the pressure and/or volume changes of the coolant 22 resulting from the heat up and cool down of the engine 12. A valve 24 may be located in coolant line 16 between the engine 12 and radiator 14 and is operable to direct a portion of the coolant 22 to bypass the radiator 14. Valve 24 may have a plurality of positions ranging from a minimum cooling position where a minimum amount of the coolant 22 is directed to the radiator 14, to a maximum cooling position wherein a minimum amount of the coolant 22 is directed to bypass the radiator 14. A fan 26 is located proximate radiator 14 and is operable to move air or other cooling medium past the radiator 14 to transfer heat away from the radiator 14 and to the air. Fan 26 may have a range of speeds including a minimum cooling mode wherein the fan is stopped or is rotated at a minimum speed, to a maximum cooling mode wherein the fan is rotated at its maximum speed. For example, fan 26 may be driven by an electric motor that is adjustable to discreet percentages of full speed, and that full speed may be a function of the speed of rotation of the engine 12. Importantly, fan 26 may have one or more speeds above a minimum speed that represent an increased cooling mode. Engine cooling apparatus 10 may also include one or more shutters 28 located proximate the radiator 14 and operable to control the flow of the air or other cooling medium past the radiator 14. Shutter 28 may have a range of positions including a minimum cooling position wherein the shutters are closed to hinder air passage to a maximum cooling position wherein the shutters are fully opened.

In addition to the mechanical components described above, engine cooling apparatus 10 may include control components such as controller 30. Controller 30 is operable to control the operation of the other components of cooling apparatus 10. Controller 30 may be embodied as hardware, such as a programmable logic controller or microprocessor, or as software, or as a combination of both hardware and software. Controller 30 may include a variety of input and output connections. Coolant sensor 32 is operable to measure the temperature of the coolant 22 and to produce a corresponding temperature signal 34 for input to controller 30. Ambient temperature sensor 36 is operable to measure the temperature of the ambient environment proximate the engine 12 and to provide an ambient temperature signal 38 to controller 30. In an embodiment where engine 12 is utilized to propel a vehicle (not shown), a motion sensor 40 is operable to sense motion of the vehicle and to provide a motion signal 42 to controller 30. Similarly, a brake sensor 44 is operable to sense the operation of the brakes (not shown) of such a vehicle and to provide a braking signal 46 to controller 30.

Controller 30 includes circuitry operable to produce a variety of output signals for controlling various components of the engine cooling apparatus 10. Pump control signal 48 may control the speed of operation of pump 18. Valve control signal 50 controls the position of valve 24. Fan control signal 52 controls the speed of operation of fan 26. Shutter control signal 54 controls the position of shutter 28. The operation of engine 12 may be controlled by an engine control device 56, such as an ignition system, fuel injection system, throttle, or combination thereof as may be known in the art. Engine control signal 58 is provided to control the operation of engine 12 by means of engine control device 56.

The operation of engine cooling apparatus 10 may be initiated by a maintenance cool down signal 60 provided to controller 30 from an operator controlled key 62. Key 62 may be a simple manual switch, or may be an output from a control system, such as may be available for applications such as a locomotive engine. The assignee of the present invention provides an Integrated Functional Display TM control system with certain of its locomotive engines wherein key 62 may be embodied as a special code to be entered by the operator.

Figure 2:
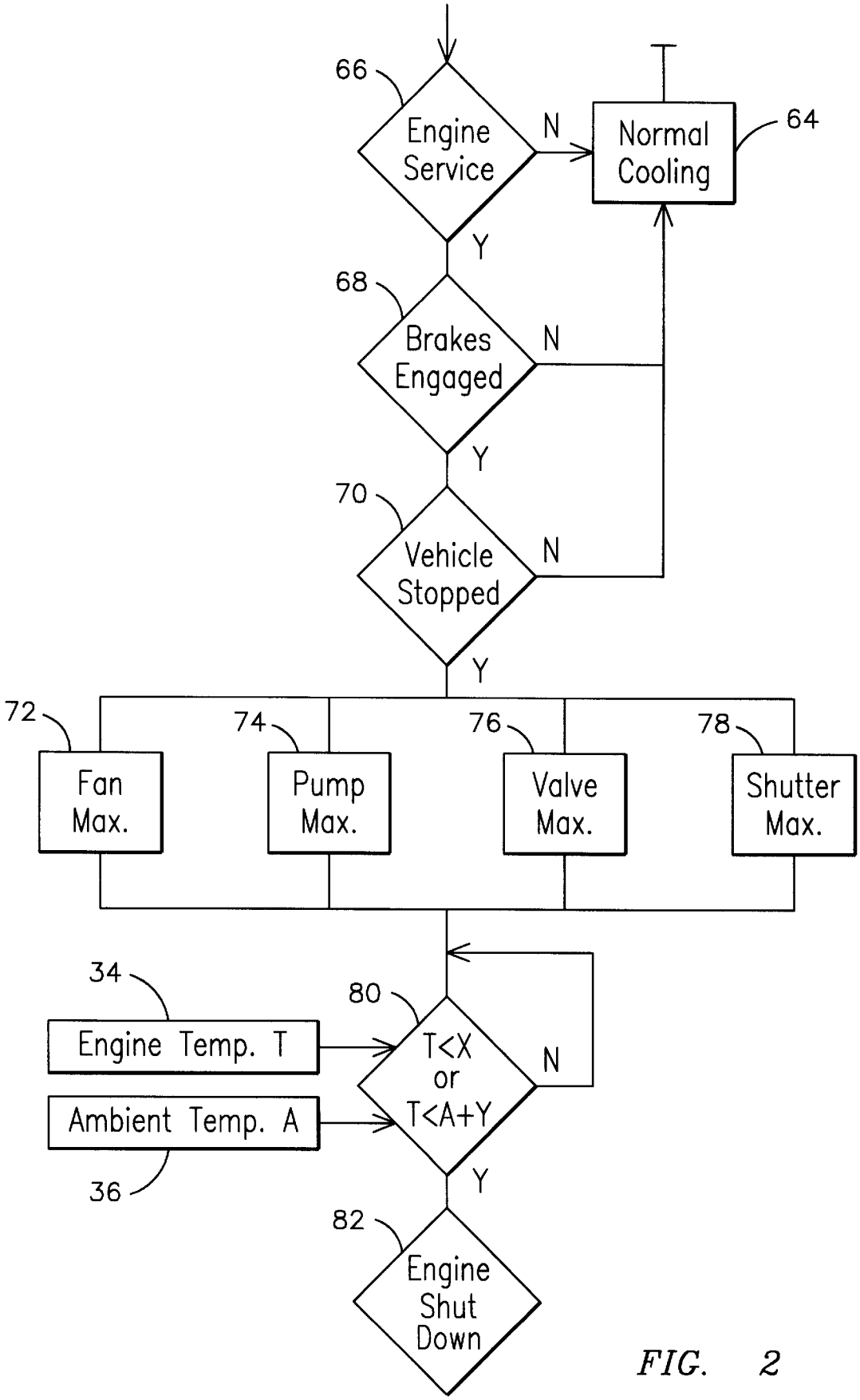
FIG. 2 is a logic diagram of a method of preparing an engine for maintenance.

The operation of the engine cooling apparatus 10 of FIG. 1 may now be explained by reference to a sequence of steps illustrated in FIG. 2. Engine 12 may be operated in its normal cooling mode in step 64 until it is returned to a maintenance facility for maintenance or repair services. An operator will then activate key 62 to provide a maintenance cool down signal 60. Logic within controller 30 is operable in step 66 to determine if maintenance cool down signal 60 is present. The logic in controller 30 may be embodied in hardware and/or software as is known in the art. Additional logical steps may be performed within controller 30 to determine if brake control signal 46 and/or motion control signal 42 are present, as illustrated in steps 68 and 70 respectively. Assuming the above preconditions exist, controller 30 is programmed to generate one or more of the control signals 48, 50, 52, 54 to place one or more of the pump 18, valve 24, fan 26, and/or shutter 28 in its maximum or increased cooling mode, as illustrated by steps 72, 74, 76, 78. Not all of these components will be present and/or controllable to a maximum or increased cooling mode in every embodiment of this invention. For example, in one embodiment, only fan 26 is controllable to an increased cooling mode, but the other components are either not present or are not controllable by the controller 30.

The engine cooling system component(s) controlled by controller 30 is/are maintained in a maximum or increased cooling mode until the temperature of the engine 12 drops below a predetermined value. The predetermined value may be a fixed temperature that is pre-programmed into controller 30, or it may be a variable temperature selected by the operator, or it may be a function of the ambient temperature in the area of engine 12. In one embodiment, coolant temperature signal 34 is compared to the predetermined temperature X in step 80 of FIG. 2. For an embodiment wherein the predetermined temperature is a function of the ambient temperature, ambient temperature signal 38 is utilized in step 80 to determine the temperature above which the cooling system 10 is maintained in its maximum mode. For example, logic in controller 30 may determine if engine temperature T is less than the ambient temperature A plus a predetermined value Y. In the embodiment of an engine cooling apparatus 10 for a diesel locomotive engine 12 supplied by the assignee of this invention, it is possible to cool the engine from its normal operating temperature of approximately 170 degrees Fahrenheit to 210 degrees Fahrenheit to within about 10 degrees Fahrenheit above the ambient temperature in a period of only 10–15 minutes by operating the various components of the cooling system in their increased cooling modes. This results in a savings of 8–12 hours compared to the normal cool down period wherein cooling is performed by passive natural circulation of the air around the locomotive engine. Once the predetermined temperature value has been obtained, logic within controller 30 will deactivate the engine 12 in step 82 by providing an appropriate engine control signal 58 to engine controller 56. The active components of the engine cooling apparatus 10, such as the fan 26 and pump 18, are similarly deactivated in step 82.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and the scope of the appended claims.

What is claimed is:

1. An engine cooling apparatus operable for reducing the amount of time necessary to cool an engine from its normal operating temperatures to a lower temperature wherein maintenance operations may be safely accomplished, the apparatus comprising:

a radiator in fluid communication with an engine;

a pump operable to pump fluid between the engine and the radiator to transfer heat from the engine to the radiator;

a fan operable to move air past the radiator to transfer heat from the radiator to the air, the fan having a first and a second cooling speed, the first cooling speed being the speed at which the fan operates, as the engine is operating, to cool the engine to its normal operating temperatures, the second cooling speed being higher than the first cooling speed for transferring heat, as the engine is operating, at a higher rate than the first cooling speed;

a sensor operable to measure temperature indicative of engine temperature and to produce a corresponding temperature signal;

a controller operatively connected to the fan, the sensor and the engine and having an input for receiving a maintenance cool down signal;

logic within the controller operable to produce a signal for placing the fan in the second cooling speed upon receipt of the maintenance cool down signal; and logic within the controller operable to deactivate the engine when the measured temperature drops below a predetermined value after receipt of the maintenance cool down signal to enable maintenance to be performed on the engine.

2. The engine cooling apparatus of claim 1, further comprising logic within the controller operable to deactivate the fan when the temperature signal reaches a predetermined value after receipt of the maintenance cool down signal.

3. The engine cooling apparatus of claim 1, wherein the predetermined value is a function of the ambient temperature.

4. The engine cooling apparatus of claim 1, wherein the pump has an increased cooling mode, and further comprising:

logic within the controller operable to produce a signal for placing the pump in its increased cooling mode upon receipt of the maintenance cool down signal.

5. The engine cooling apparatus of claim 1, further comprising:

a valve operable to direct a portion of the fluid to bypass the radiator, the valve having a maximum cooling position wherein a minimum amount of the fluid bypasses the radiator;

logic within the controller operable to produce a signal for placing the valve in its maximum cooling position upon receipt of the maintenance cool down signal.

6. The engine cooling apparatus of claim 1, further comprising:

a shutter operatively connected to the controller and operable to control the flow of air moving past the radiator, the shutter having a maximum cooling position;

logic within the controller operable to produce a signal for placing the shutter in its maximum cooling position upon receipt of the maintenance cool down signal.

7. The engine cooling apparatus of claim 1, further comprising:

a motion sensor operable to sense motion of a vehicle in which the engine is contained and operable to produce a signal corresponding to such motion, the motion sensor operatively connected to the controller;

logic within the controller to disable the signal for placing the fan in the second cooling speed when the vehicle is in motion.

8. The engine cooling apparatus of claim 1, further comprising:

a brake sensor operable to sense the operation of brakes on a vehicle in which the engine is contained and operable to produce a signal corresponding to such brake operation, the brake sensor operatively connected to the controller;

logic within the controller to enable the signal for placing the fan in the second cooling speed only when the brakes are in operation.

9. A method for reducing the amount of time necessary to cool an engine from its normal operating temperatures to a lower temperature wherein maintenance operations may be safely accomplished, the engine having a cooling system having a first cooling mode for operation of the engine while transferring heat from the engine at a first rate, and a second cooling mode, the second cooling mode transferring heat at a higher rate than the first cooling mode, the method comprising:

placing the engine cooling system in the second cooling mode upon the receipt of a maintenance cool down signal;

maintaining the engine cooling system in the second cooling mode until the temperature of the engine drops below a predetermined value; and deactivating the engine once the temperature of the engine drops below the predetermined value to enable maintenance to be performed on the engine.

10. The method of claim 9, wherein the step of placing the engine cooling system in the second cooling mode comprises operating a radiator fan at above its minimum speed.

11. The method of claim 9, wherein the step of placing the engine cooling system in the second cooling mode comprises operating a cooling system pump at above its minimum speed.

12. The method of claim 9, wherein the step of placing the engine cooling system in the second cooling mode comprises switching a coolant bypass valve to a position wherein a minimum amount of coolant bypasses a radiator.

13. The method of claim 9, wherein the step of placing the engine cooling system in the second cooling mode comprises opening a shutter associated with a radiator.

14. The method of claim 9, further comprising the steps of:

determining the ambient temperature;

setting the predetermined temperature to be a predetermined amount higher than the ambient temperature.

15. The method of claim 9, further comprising the steps of:

prior to the step of placing the engine cooling system in the second cooling mode, ensuring that the brakes of the vehicle in which the engine is contained are engaged.

16. A method for reducing the amount of time necessary to cool an engine from its operating temperature to a temperature wherein maintenance operations may be safely accomplished, the engine having a cooling system having a first and a second cooling mode, the second cooling mode transferring heat at a higher rate than the first cooling mode, the method comprising the steps of:

placing the engine cooling system in the second cooling mode upon the receipt of a maintenance cool down signal;

maintaining the engine cooling system in the second cooling mode until the temperature of the engine drops below a predetermined value; and deactivating the engine and engine cooling system once the temperature of the engine drops below the predetermined value; and prior to the step of placing the engine cooling system in the second cooling mode, ensuring that the vehicle in which the engine is contained is not moving.

17. An engine cooling apparatus operable for reducing the amount of time necessary to cool an engine from its normal operating temperature to a lower temperature wherein maintenance operations may be safely accomplished, the apparatus comprising:

a cooling apparatus connected to an engine for removing heat from the engine, the cooling apparatus having a first mode of operation for removing heat from the engine at a first rate during operation of the engine to cool the engine to a normal operating temperature and having a second mode of operation for transferring heat from the engine at a second rate during operation of the engine, the second rate being greater than the first rate;

a signal generator for selectively providing a cool down signal;

a controller connected to the cooling apparatus and to the signal generator;

logic within the controller operable to place the cooling apparatus in the second mode of operation upon receipt of the cool down signal to cool the engine to a temperature lower than the normal operating temperature.

18. The engine cooling apparatus of claim 17, further comprising:

an engine control device associated with the engine and connected to the controller;

a sensor associated with the engine for providing an engine temperature signal to the controller;

logic within the controller operable to provide a signal to the engine control device for deactivating the engine when the engine temperature signal obtains a predetermined value.

19. The engine cooling apparatus of claim 18, further comprising:

an ambient temperature sensor for providing an ambient environment temperature signal to the controller;

logic within the controller operable to provide a signal to the engine control device for deactivating the engine when the engine temperature signal obtains a value corresponding to an engine temperature a predetermined value above the ambient temperature.

20. The engine cooling apparatus of claim 17, wherein the cooling apparatus further comprises a fan having a low speed and a high speed, the fan connected to the controller, and further comprising:

logic within the controller operable to generate a signal for operating the fan at the high speed upon receipt of the cool down signal.

* * * * *